US010576657B2

(12) United States Patent
Johnson et al.

(10) Patent No.: US 10,576,657 B2
(45) Date of Patent: Mar. 3, 2020

(54) MOLDS FOR PRODUCING CONCRETE BLOCKS WITH ROUGHENED SURFACES; BLOCKS MADE THEREFROM; AND METHODS OF USE

(71) Applicant: Anchor Wall Systems, Inc., Minnetonka, MN (US)

(72) Inventors: Jay Johnson, Star Prairie, WI (US); Wally Hernandez, Brooklyn Park, MN (US); Paul Johnson, Clearwater, MN (US); Mike Lidbom, Big Lake, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 210 days.

(21) Appl. No.: 15/850,745

(22) Filed: Dec. 21, 2017

(65) Prior Publication Data

US 2018/0117791 A1 May 3, 2018

Related U.S. Application Data

(63) Continuation of application No. 14/987,079, filed on Jan. 4, 2016, now Pat. No. 9,878,465, which is a continuation of application No. 13/019,744, filed on Feb. 2, 2011, now Pat. No. 9,259,853.

(51) Int. Cl.

| | |
|---|---|
| ***B28B 7/00*** | (2006.01) |
| ***B28B 7/36*** | (2006.01) |
| ***B28B 17/00*** | (2006.01) |
| ***E04B 2/14*** | (2006.01) |
| ***E04C 1/39*** | (2006.01) |
| ***B44F 9/04*** | (2006.01) |

(52) U.S. Cl.
CPC ..... *B28B 7/007* (2013.01); *B28B 7/0061* (2013.01); *B28B 7/0097* (2013.01); *B28B 7/366* (2013.01); *B28B 17/0027* (2013.01); *B44F 9/04* (2013.01); *E04B 2/14* (2013.01); *E04C 1/395* (2013.01)

(58) Field of Classification Search
CPC ..... B28B 7/007; B28B 7/366; B28B 17/0027
See application file for complete search history.

(56) References Cited

U.S. PATENT DOCUMENTS

| | | | |
|---|---|---|---|
| 1,007,623 | A | 10/1911 | Zwicker |
| 1,465,608 | A | 8/1923 | McCoy |
| 2,463,269 | A | 3/1949 | Haskins |
| 3,940,229 | A | 2/1976 | Hutton |

(Continued)

FOREIGN PATENT DOCUMENTS

| | | | |
|---|---|---|---|
| EP | 140721 | A1 | 5/1985 |
| EP | 175038 | A1 | 3/1986 |

(Continued)

OTHER PUBLICATIONS

International Search Report and Written Opinion dated Jun. 25, 2012.

*Primary Examiner* — James Sanders
(74) *Attorney, Agent, or Firm* — Merchant & Gould P.C.

(57) ABSTRACT

A mold for making dry cast concrete blocks includes a pair of vertical shoulder forming sections, one along each of the opposite sides of the mold to form vertical front shoulders of a block. Each shoulder forming section has a shoulder roughening arrangement to result in molded, roughened shoulders of the block. Methods of making such blocks and the resulting block are included.

7 Claims, 5 Drawing Sheets

(56) References Cited

U.S. PATENT DOCUMENTS

| | | | |
|---|---|---|---|
| 4,023,767 | A | 5/1977 | Fontana |
| 4,050,865 | A | 9/1977 | Drostholm et al. |
| 4,080,767 | A | 3/1978 | Wilhelm |
| 4,098,865 | A | 7/1978 | Repasky |
| 4,896,472 | A | 1/1990 | Hunt |
| 5,062,610 | A | 11/1991 | Woolford et al. |
| 5,078,940 | A | 1/1992 | Sayles |
| 5,249,950 | A | 10/1993 | Woolford |
| 5,294,216 | A | 3/1994 | Sievert |
| 5,297,772 | A | 3/1994 | Stefanick |
| 5,358,214 | A | 10/1994 | Batlle |
| 5,445,514 | A | 8/1995 | Heitz |
| 5,589,124 | A | 12/1996 | Woolford et al. |
| D391,376 | S | 2/1998 | Strand et al. |
| 5,879,603 | A | 3/1999 | Sievert |
| 6,029,943 | A | 2/2000 | Sievert |
| 6,050,255 | A | 4/2000 | Sievert |
| 6,138,983 | A | 10/2000 | Sievert |
| 6,209,848 | B1 | 4/2001 | Bolles et al. |
| 6,224,815 | B1 | 5/2001 | LaCroix et al. |
| 6,322,742 | B1 | 11/2001 | Bott |
| 6,464,199 | B1 | 10/2002 | Johnson |
| 6,874,494 | B2 | 4/2005 | Scherer et al. |
| D509,909 | S | 9/2005 | Sorheim |
| 7,172,404 | B2 | 2/2007 | Braungardt et al. |
| 7,267,321 | B1 | 9/2007 | Morrell |
| 7,497,646 | B2 | 3/2009 | Price |
| 7,575,217 | B2 | 8/2009 | Jucha et al. |
| 7,704,434 | B2 | 4/2010 | Johnson |
| 8,016,584 | B2 | 9/2011 | Braungardt et al. |
| 8,101,113 | B2 | 1/2012 | Castonguay et al. |
| 9,259,853 | B2 | 2/2016 | Johnson et al. |
| 2004/0098928 | A1 | 5/2004 | Scherer et al. |
| 2004/0175243 | A1 | 9/2004 | Correla |
| 2006/0145050 | A1 | 7/2006 | Price et al. |
| 2006/0273492 | A1 | 12/2006 | Johnson |
| 2007/0007426 | A1 | 1/2007 | Grote et al. |
| 2008/0307740 | A1 | 12/2008 | MacDonald |
| 2009/0000233 | A1 | 1/2009 | Hammer |
| 2009/0103987 | A1 | 4/2009 | MacDonald |

FOREIGN PATENT DOCUMENTS

| | | |
|---|---|---|
| GB | 2209135 | 5/1989 |
| JP | 03292106 | 12/1991 |
| JP | 04141403 | 5/1992 |
| JP | 06114810 | 4/1994 |
| JP | 06114815 | 4/1994 |
| WO | WO 00/01517 | 1/2000 |
| WO | WO 02/40235 A2 | 5/2002 |
| WO | WO 03/041929 A1 | 5/2003 |

MOLDS FOR PRODUCING CONCRETE BLOCKS WITH ROUGHENED SURFACES; BLOCKS MADE THEREFROM; AND METHODS OF USE

CROSS-REFERENCE TO RELATED APPLICATION

This application is a continuation of U.S. application Ser. No. 14/987,079 filed Jan. 4, 2016 which is a continuation of U.S. application Ser. No. 13/019,744 filed Feb. 2, 2011, issued as U.S. Pat. No. 9,259,853. This application is incorporated herein by reference in its entirety.

TECHNICAL FIELD

This disclosure concerns molds for concrete products. In particular, this disclosure concerns molds for making dry cast concrete blocks, in which surfaces of the resulting block are roughened.

BACKGROUND

Concrete units are available in a wide range of sizes and shapes, and are used for a variety of applications ranging from concrete blocks and bricks for building construction to landscaping units, including segmental retaining wall blocks (the latter are sometimes called "SRW" blocks).

Depending on the intended end-use application of the concrete units being produced, the surface appearance of the units may be important, and the marketplace has come to expect various decorative or cosmetic surface finishes for many units. Such surface finishes include those commonly described as broken or split, striped, striated, simulated broken, and smooth (alone or in combination with one of the other surface finishes). One such surface finish is a texture that resembles the appearance of a "split" rock. A "split" surface finish on a concrete unit may be achieved by mechanically splitting away a portion of a face of the masonry unit. This is typically achieved with a mechanical splitting blade similar to a guillotine, and the splitting is performed on the units after they have been cured or hardened. To avoid waste, this is often done by first forming the units as "Siamese" twins and then splitting them apart. The resulting fracture surface on the front face of both blocks is generally thought to be aesthetically pleasing and decorative.

The mechanical splitting of units is an added cost of processing. This cost provides an incentive to develop new methods of roughening the surface of concrete units to create a desirable surface finish without the need to mechanically split the masonry units. Although some approaches have involved processing steps to be performed on the green or uncured masonry units immediately after they are discharged from the mold, one common approach has been to modify the mold in some fashion so that a roughened surface is produced on the concrete units as they are ejected from the mold (i.e. the units are roughened in the mold cavity).

At times, it is desired to produce a more modest or fine roughening of a masonry unit than is typically produced when mechanically splitting a block. Unfortunately, the molds used to produce pronounced roughening are often unsuited for the more modest roughening. If they are scaled down to produce more moderate roughening, they often have more delicate features that lack the desired strength and wearability.

Modest roughening of one or more surfaces of a concrete unit such as a brick or block is useful not only as the only surface finish, but it is useful in combination with mechanical splitting where the modest roughening can be performed on surfaces of the block which are not to be mechanically split, but which may be visible to the observer when the products are used, for example, to create a retaining wall. By roughening the surfaces immediately adjacent to the mechanically split surface(s), light striking the adjacent surfaces is scattered and the reflections associated with smooth reflective surfaces are avoided.

SUMMARY

This disclosure relates to an improved mold that is well suited for making concrete products having roughened vertical front shoulders.

In accordance with principles of this disclosure, a mold for making dry cast concrete blocks includes opposed side walls, opposed end walls, and an open top and bottom. The mold includes a pair of vertical shoulder forming sections, one along each of the side walls across the mold from each other in position to form the vertical front shoulders of a dry cast concrete block. Each shoulder forming section is concave about a vertical axis to form a rounded front vertical shoulder on a block. Each shoulder forming section has a recess starting adjacent the lower edge of the mold and extending upward between about 25% and about 50% of the side wall height of the side wall of the mold. One or more ribs is formed in each of the recesses. Each rib extends in a direction across the width of the recess, and the one or more ribs together extend across at least a majority of the width of the recess.

In another aspect, a presplit molded dry cast concrete block pair is provided. The block pair includes a first block form having a rear surface and first and second opposite side walls extending from the rear surface. The block pair further includes a second block form having a rear surface and first and second opposite side walls extending from the rear surface in a direct toward the first block form. A top surface is between the first rear surface and the second rear surface. A bottom surface, opposite of the top surface, is between the first rear surface and the second rear surface. First and second rounded, roughened shoulders are provided defining a gap therebetween. The first shoulder is at the end of the first block form first side wall, and the second shoulder is at the end of the second block form first side wall. There are further third and fourth rounded, roughened shoulders defining a gap therebetween. The third shoulder is at the end of the first block form second side wall, and the fourth shoulder is at the end of the second block form second side wall.

In another aspect, a method of molding a dry cast concrete block is provided. The method includes providing a mold having a cavity defined by opposed side walls, opposed end walls, an open top, an open bottom, and a pair of vertical shoulder forming sections, one along each of the side walls across the mold from each other. Each shoulder forming section is concave about a vertical axis to form a rounded front vertical shoulder on a block. Each shoulder forming section has a recess starting adjacent the lower edge of the mold and extending upward between about 25% and about 50% of the height of the mold. One or more ribs is formed in each of the recesses, each rib extending in a direction across the width of the recess, the one or more ribs together extending across at least a majority of the width of the recess. The mold has a pallet underneath to temporarily close the open bottom. The method further includes depositing dry cast concrete in the mold cavity. Next, there is a step of compacting the concrete in the mold cavity by introducing a stripper shoe through the open top of the mold box including forming vertical front shoulders having roughened surfaces by contact between the concrete and the ribs in the recesses of the shoulder forming sections. Next, there is a step of discharging an uncured concrete block through the open bottom of the mold box onto the pallet.

DETAILED DESCRIPTION

A. Overview of Example Molded Block and Block Pair, FIGS. 1-3

The present disclosure provides a mold for making a block, the resulting block, and methods of use. The resulting block includes a roughened front face and roughened rounded front shoulders, to provide the appearance of a natural rock or stone surface. The mold used to make the block includes shoulder forming sections with an arrangement for providing the roughness on the vertical shoulders of the resulting molded block.

Figure 1:
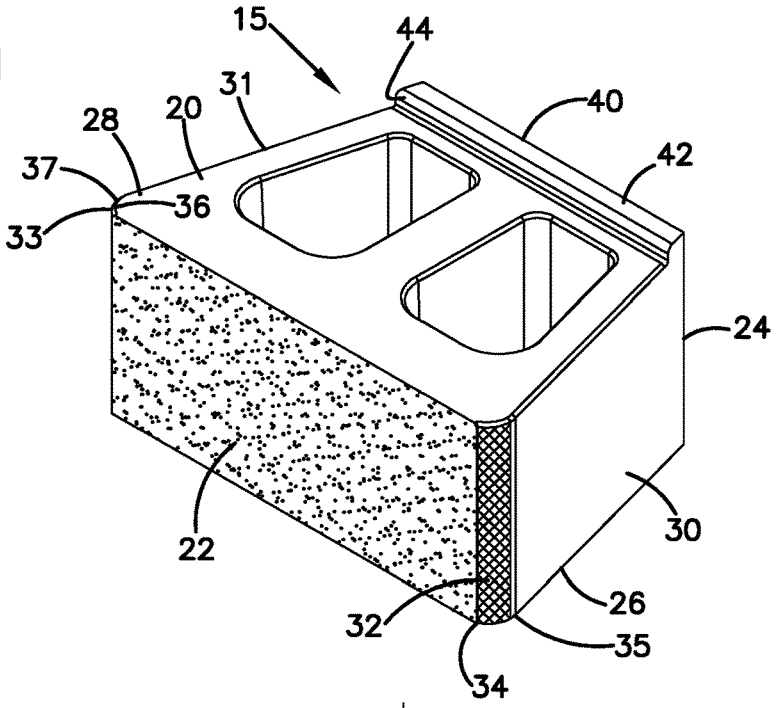
FIG. 1 is a perspective view of one embodiment of a retaining wall block made in accordance with principles of this disclosure.

Referring now to FIG. 1, one example embodiment of a dry cast concrete block according to principles of this disclosure is shown generally at 15. In the example shown, the block 15 includes a block body 20 including a front surface 22 and a back surface 24, which are substantially parallel to each other. The front 22 and back 24 surfaces are separated by a distance comprising the depth of the block. The block has an upper surface 26 and a lower surface 28 separated by a distance comprising the height of the block 15. In FIG. 1, the block 15 is depicted upside-down from the orientation it has in use. In use, the lower surface 28 is the base surface.

The block has a first 30 and second 31 side wall separated by a distance comprising the width of the block. The side walls 30, 31 join the block upper and lower surfaces 26, 28. At the intersection between the front surface 22 and first side wall 30 is a first shoulder 32. At the intersection between the front surface 22 and the second side wall 31 is a second shoulder 33. The first and second shoulders 32, 33 extend vertically between the lower surface 28 and upper surface 26. In one embodiment, the radius of the first shoulder 32 and second shoulder 33 is the same and ranges between 1.00-1.10 inch, preferably about 1.099 inch. In the embodiment shown, the first shoulder 32 extends between the point 34 where the front surface 22 stops and the point 35 where the first side wall 30 stops. Similarly, the second shoulder 33 extends between point 36 where the front surface 22 stops and point 37 where the second side wall 31 stops.

In the embodiment shown, the first side wall 30 and second side wall 31 are angled and converge as they extend from the front surface 22 to the back surface 24. These converging side walls 30, 31 result in blocks 15 that can be manipulated to form curved walls.

The block 15 has a flange 40 spanning the width of the block back surface 24 and extending from the block back surface 24 past the height of the block. Generally, the flange 40 comprises a set back surface 42 and a locking surface 44. The set back surface 42 extends from the lower edge of the flange 40 in a plane parallel to the block upper 26 and lower 28 surfaces towards the block front surface 22. The locking surface 44 extends from the plane of the block lower surface 28 to the set back surface 42.

The block body 20 provides weight and physical structure to the system in which the block 15 is used. Landscaping elements, such as retaining walls, often must be constructed of units that not only provide a structural impediment to resist the natural flow of soil, but must also provide the shear weight to withstand these forces. Moreover, the body of the block 15 functions to provide the supporting surfaces that may be used to provide an aesthetically pleasing pattern such as that found on the front surface 22 of the block 15. The body 20 of the block 15 may also provide a substrate for holding elements that help form an interlocking matrix with other blocks when used in a structure such as a wall. In particular, the block 15 includes flange 40, which assists in the interlocking function of the block 15.

The block front surface 22 preferably has a roughened appearance to enhance the aesthetic appeal of the block. The roughened appearance is preferably formed by splitting two face-to-face concrete blocks molded into a block pair. One example of a molded block pair is shown in FIGS. 2 and 3.

Figure 2:
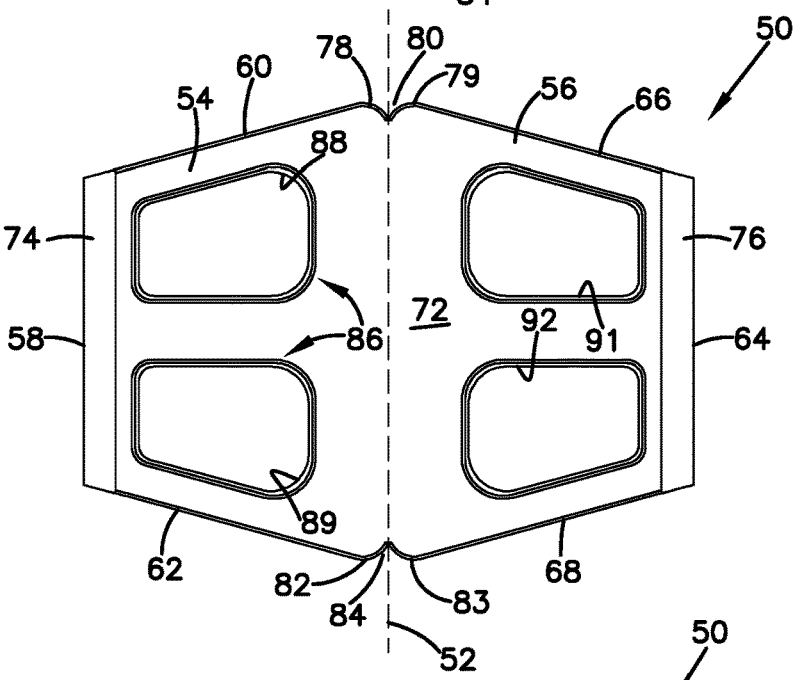
FIG. 2 is a top view of a pre-split molded dry cast concrete block pair, made in accordance with principles of this disclosure.
Figure 3:
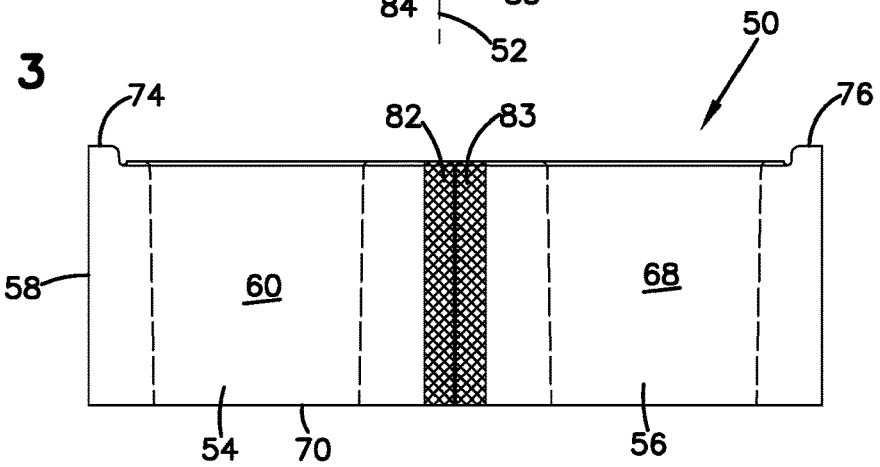
FIG. 3 is a side view of the pre-split molded dry cast concrete block pair of FIG. 2.

Referring now to FIGS. 2 and 3, a molded block pair is shown generally at 50. The molded block pair 50 depicted in FIGS. 2 and 3 is pre-split. That is, the molded block pair 50, in the pre-split form as shown in FIGS. 2 and 3, is an intermediate form before appearing as block 15 with the roughened front surface 22. Generally, the molded block pair 50 is split along a split line 52 (FIG. 2), which bisects the block pair 50. The splitting can be done by using a conventional block splitter having a splitting blade, and may include splitters such as those described in U.S. Pat. No. 6,874,494, incorporated by reference herein. After splitting the molded block pair 50, the result is two individual blocks 15, each block having a roughened front surface 22, resulting from the split. In accordance with principles of this disclosure, the block 15, after splitting, also has roughened first and second shoulders 32, 33.

In FIG. 2, the molded block pair 50 includes first and second block forms 54, 56 that are molded as a single, continuous piece with the split line 52 therebetween. The first block form 54 has a rear surface 58 and first and second opposite side walls 60, 62 extending from the rear surface 58. The second block form 56 also has a rear surface 64 and first and second opposite side walls 66, 68 extending from the second form rear surface 64 and in a direction toward the first block form 54. The molded block pair 50 further includes a top surface 70 (FIG. 3) extending between the first block form rear surface 58 and the second block form rear surface 64. A bottom surface 72, opposite of the top surface 70, extends between the first block form rear surface 58 and the second block form rear surface 64. The block pair 50 of FIGS. 2 and 3 is depicted upside-down, with the bottom surface 72 facing up. After splitting, in normal use the two split blocks 15 will rest on bottom surface 72.

In FIGS. 2 and 3, it can also be seen how in this embodiment, the first block form 54 has a flange 74 extending along the rear surface 58 and projecting above the bottom surface 72. Similarly, the second block form has a flange 76 extending along the rear surface 64 and projecting above the bottom surface 72.

The molded block pair 50 further includes first and second shoulders 78, 79 defining a gap 80 therebetween. The first and second shoulders 78, 79 are rounded and roughened. In FIG. 2, the first shoulder 78 is adjacent the split line 52 and at the end of the first block form first side wall 60. The second shoulder 79 is adjacent to the split line 52 and is at the end of the second block form first side wall 66. As used herein, the term "gap" refers to the distance between the outermost radius of each of the first and second shoulders 78, 79. The split line 52 bisects the gap 80.

Analogously, at the opposite side of the molded block pair 50, are a third and fourth shoulders 82, 83 defining a gap 84 therebetween. The third shoulder 82 and the fourth should 83 are rounded and roughened. The third shoulder 82 is at the end of the first block form second side wall 62, while the fourth shoulder 83 is at the end of the second block form second side wall 68. Each of the third and fourth shoulders 82, 83 are adjacent to the split line 52, with the first shoulder 78 and third shoulder 82 being on the same side of the split line 52 as the rest of the first block form 54. The second shoulder 79 and fourth shoulder 83 are on the same side of the split line 52 as the second block form 56. The gap 84 is bisected by the split line 82.

As mentioned above, the shoulders 78, 79, 82, 83 are roughened. By the term "roughened", it is meant that the surface texture is 3-dimensional and has a craggy appearance having a relief of between about 0.09 inch and about 0.125 inch.

As can also be seen in FIG. 2, in the preferred embodiment, the first and second side walls 60, 62 converge as they extend from the second block form 56 and split line 52 toward the rear surface 58. Similarly, the first and second side walls 66, 68 converge as they extend from the first block form 54 and split line 52 toward the rear surface 64. Stated another way, the first block form first and second side walls 60, 62 diverge as they extend from the rear surface 58 toward the second block form 56, and the second block form first and second side walls 66, 68 diverge as they extend from the second block form rear surface 64 toward the first block form 54. As described above with respect to block 15, the converging side walls results in blocks 15 that can form curved or serpentine walls.

In FIGS. 1 and 2, it is also apparent that, in the preferred embodiment, there are core openings 86. Specifically, the first block form 54 includes first and second core openings 88, 89, while the second block form 56 includes second block form first and second core openings 91, 92. The core openings 88, 89, 91, 92 result in blocks 15 having less mass, than if molded without the core openings. This results in blocks 15 that are easier to manipulate since the weight is less then a block that does not have core openings.

B. Example Mold Assembly, FIGS. 4 and 5

Figure 4:
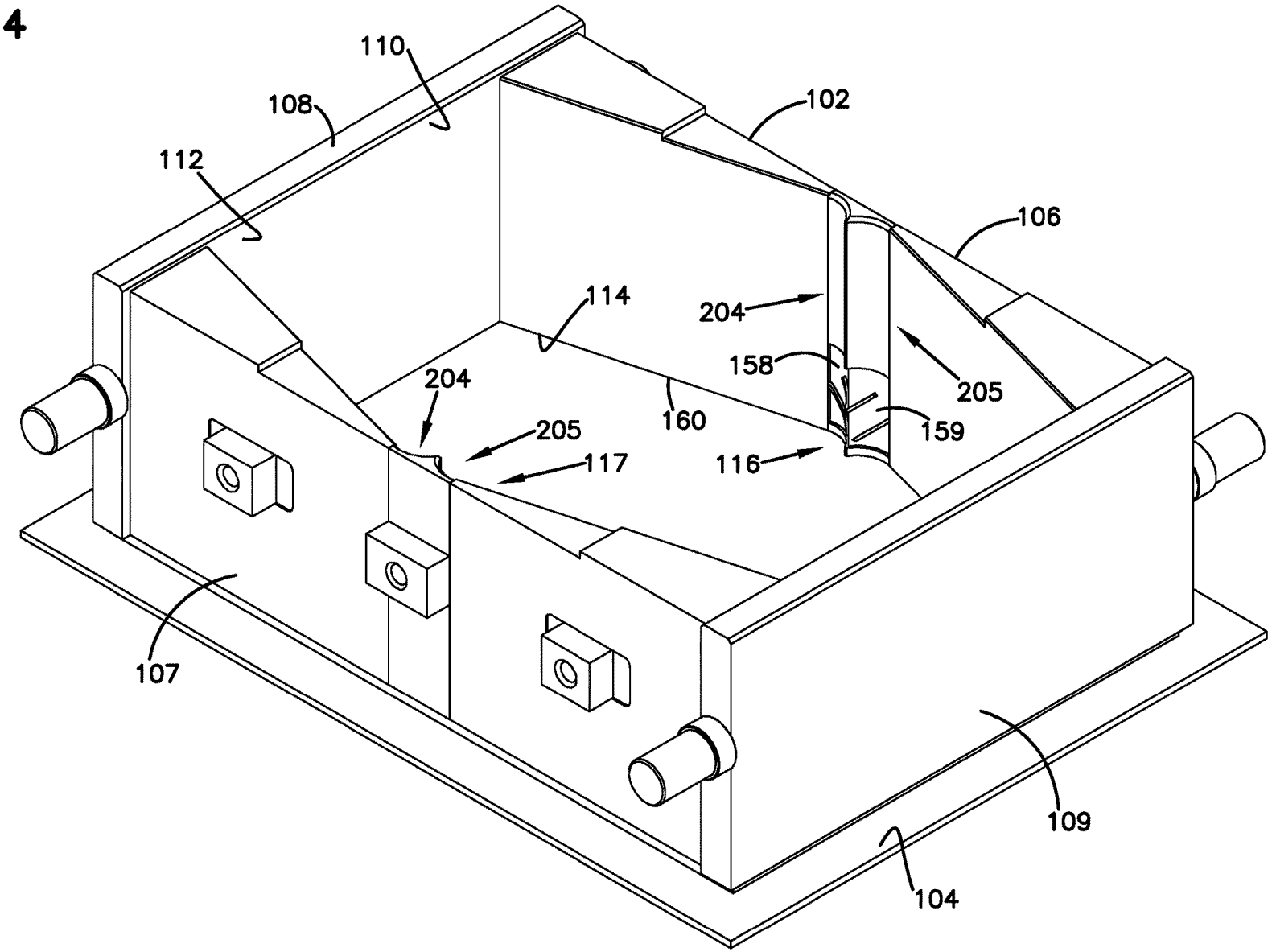
FIG. 4 is a perspective view of a mold constructed in accordance with the principles of this disclosure, the mold being used to make the pre-split molded dry cast concrete block pair of FIG. 2.
Figure 5:
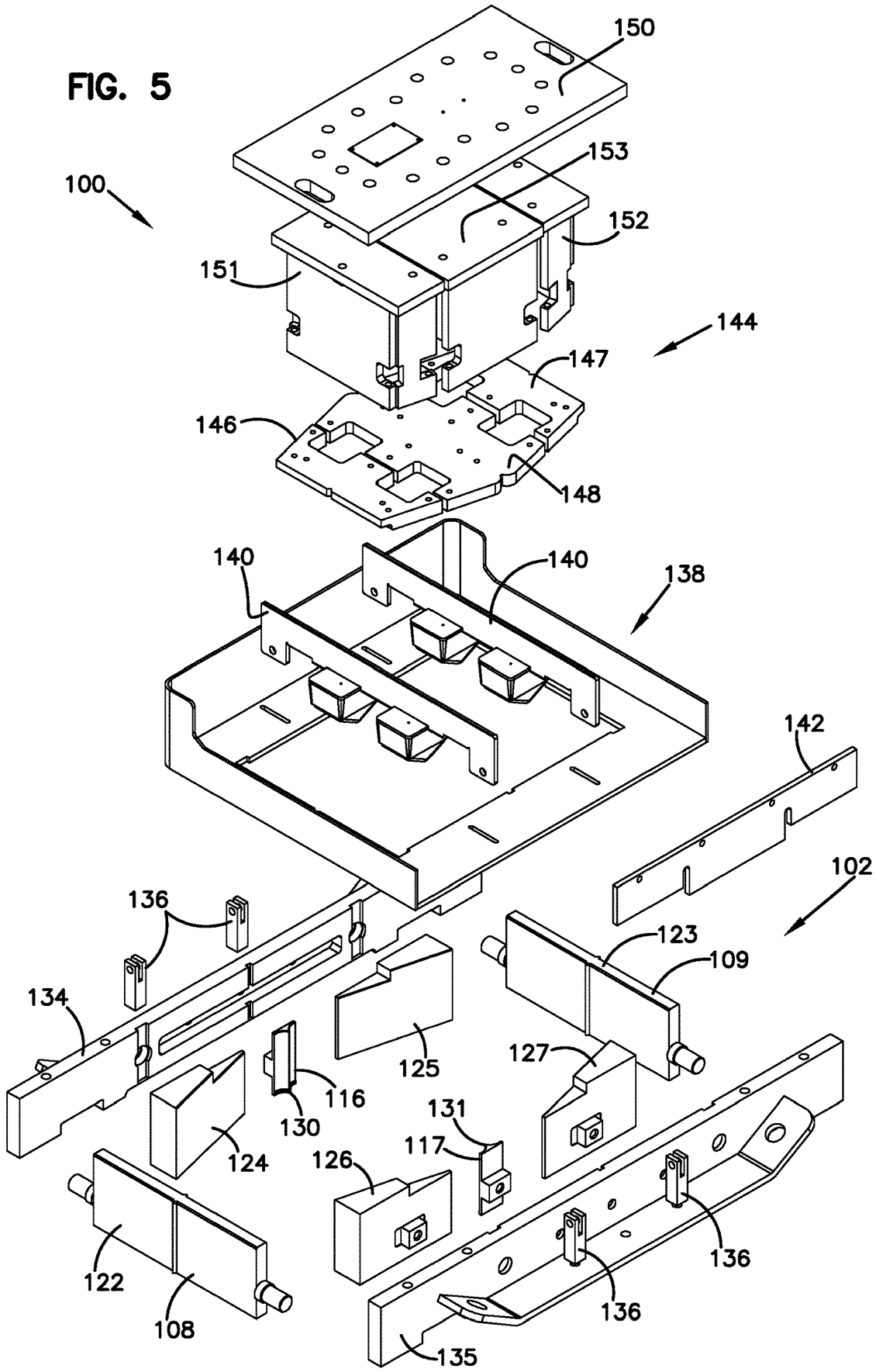
FIG. 5 is an exploded, perspective view of a mold assembly, including the mold of FIG. 4.

Referring now to FIGS. 4 and 5, an embodiment of a mold 100 (FIG. 5) used for making dry cast concrete blocks, such as block 15, is depicted. FIG. 4 shows an assembled mold box 102 resting on a pallet 104. In FIG. 5, the mold box 102 is shown in an exploded view, with additional mold parts as part of the overall mold 100, described further below.

Referring now to FIG. 4, the mold box 102 includes first and second opposed side walls 106, 107. The mold box 102 further includes first and second opposed end walls 108, 109. Together, the side walls 106, 107 and end walls 108, 109 define a mold cavity 110. The mold cavity 110 has an open top 112 and an open bottom 114. In FIG. 4, the open bottom 114 is closed by the pallet 104.

The mold box 102 further includes a pair of vertical shoulder forming sections, in the form of a first vertical shoulder forming section 116 and a second vertical shoulder forming section 117. The vertical shoulder forming sections 116, 117 are mirror-images of each other. There is one vertical shoulder forming section 116, 117 along each of the side walls 106, 107 across the mold box 102 from each other in position to form the vertical front shoulders, such as the first shoulder 32 and second shoulder 33, of the dry cast concrete block 15.

The first and second shoulder forming sections 116, 117 are constructed and arranged to result in vertical shoulders on a molded block, such as shoulders 32, 33 on block 15, in which the shoulders are roughened.

Preferably, each shoulder forming section 116, 117 is concave about a vertical axis, which is orthogonal to the pallet 104. Certain preferred shoulder forming sections are described more fully below with respect to FIGS. 7-11. The first and second shoulder forming sections 116, 117 are part of the overall mold 100, shown in exploded view in FIG. 5.

The mold 100 shown in FIG. 5 is a type of mold that would be used for making the molded block pair 50 of FIGS. 2 and 3. In other embodiments, the mold 100 can be the type of mold that would result in a single block, rather than a block pair, and the single block would not then be subject to splitting. The single block, however, may be subject to other types of roughening after de-molding and curing, such as breaking off an end piece to form a roughened front face.

In FIG. 5, the mold cavity 110 is defined by first and second outside division plates 122, 123. In the assembled mold box 102 of FIG. 4, these first and second division plates 122, 123 correspond to the first and second end walls 108, 109. The mold cavity 110 is further defined by a plurality of wear plates 124, 125, 126, 127. Between the wear plates 124 and 125 is a center wear plate 130. Between the wear plates 126 and 127 is another center wear plate 131. Together, the wear plates 124, 125, and center wear plate 130 form the first side wall 106 of the mold box 102 of FIG. 4. Similarly, the wear plates 126, 127 and center wear plate 131 form the second side wall 107 of the mold box 102. Therefore, in FIG. 5, the mold cavity 110 is defined by first and second division plates 122, 123; wear plates 124, 125, 126, 127; and center wear plates 130, 131. The center wear plates 130, 131 form the first and second shoulder forming sections 116, 117. This is described further below in section C.

As can be seen in FIG. 5, the wear plates 124-127 are shaped such that they diverge from each other as they extend from the respective division plate 122, 123 in a direction toward the respective center wear plate 130, 131.

The outside division plates 122, 123, as well as the wear plates 124-127 and center wear plates 130, 131 are secured to first and second side bar assemblies 134, 135, which extend the length of the mold 100. Specifically, in the embodiment of FIG. 5, the first side bar assembly 134 is secured to the wear plate 124, 125 and center wear plate 130, while the second side bar assembly 135 is secured to the wear plates 126, 127 and center wear plate 131. A plurality of hold down blocks 136 are shown, and are useful for connecting the side bar assemblies 134, 135 together.

Above the portions of the mold 100 forming the mold box 102 is a mold top plate assembly 138. The mold top plate assembly 138 cooperates with the core bar assembly 140, two of which are shown in the FIG. 5 embodiment. Each of the core bar assemblies 140 helps to form core openings 88, 89, 91, 92. There is a cut off blade 142, which is used for striking off the concrete mixture of the mold 100 during the molding process.

Above the top plate assembly 138 and core bar assemblies 140 is a stripper shoe arrangement 144. The stripper shoe arrangement 144 includes outside stripper shoes 146, 147 and center stripper shoe 148. The stripper shoe arrangement 144 is arranged to slide past the core bar assemblies 140 and engage the concrete mixture through the open top 112 (FIG. 4) of the mold box 102. The stripper shoe arrangement 144 presses the concrete mixture out of the mold box 102 and onto the pallet 104 (FIG. 4) as part of the molding process.

Above the stripper shoe arrangement 144 is a top plate 150, a pair of outside plunger assemblies 151, 152, and a center plunger assembly 153. The plunger assemblies 151-153 engage the stripper shoe arrangement 144 in order to push the stripper shoe arrangement 144 through the open top 112 of the mold box 104 and push out the uncured block pair out of the mold box onto the pallet 104 (FIG. 4).

C. FIGS. 6-11, Example Center Wear Plate 130.

Referring now to FIGS. 6-11, an example embodiment of center wear plate 130 is depicted. The center wear plate 131 is identical in construction, and description of the center wear plate 130 also applies to the center wear plate 131. The center wear plate 130 includes at least one, and preferably two shoulder forming sections 156, 157. When the center wear plate 130 is assembled in mold box 102, the shoulder forming sections 156, 157 will be arranged to form the vertical shoulder forming sections 116, 117 (FIG. 4).

Figure 9:
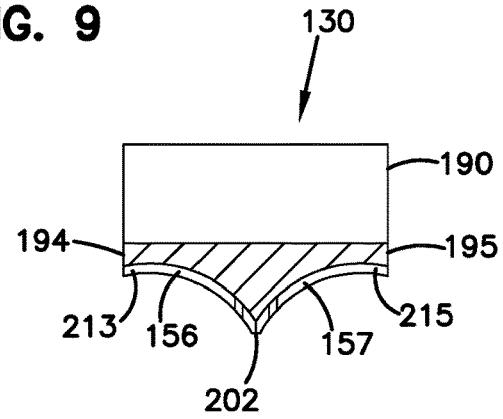
FIG. 9 is a cross-sectional view of the shoulder forming section of FIGS. 6-8, the cross-section being taken along the line 9-9 of FIG. 8.

Referring now to FIG. 9, it can be appreciated that each shoulder forming section 156, 157, is concave about a vertical axis that is orthogonal to the open top and open bottom 112, 114 of the mold box 102, when the wear plate 130 is operably installed therein. The concave shape helps to form rounded shoulders, such as shoulders 78, 79 and 82, 83 on the molded block pair 50. After splitting the molded block pair 50, rounded shoulders 32, 33 result.

Figure 6:
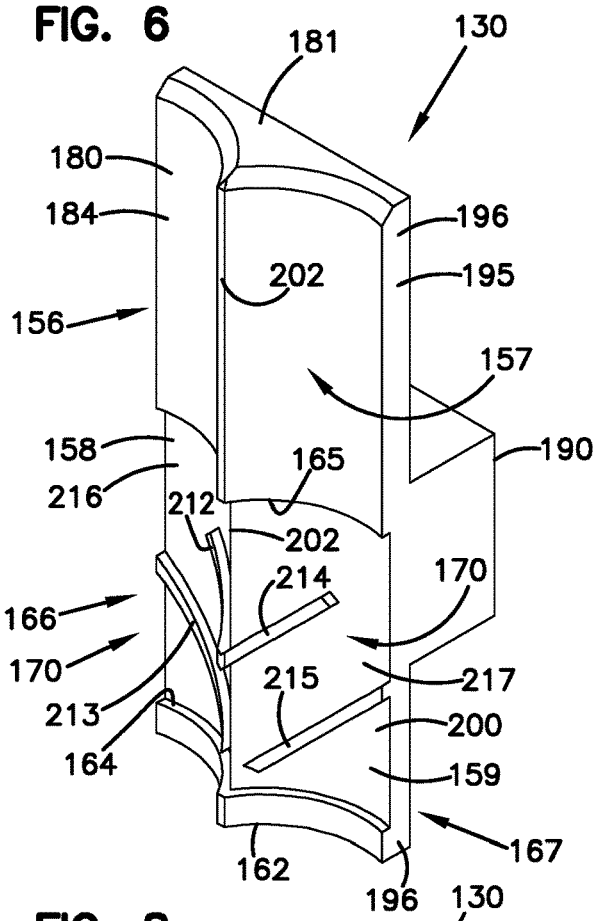
FIG. 6 is a perspective view of a shoulder forming section of the mold of FIGS. 4 and 5.
Figure 7:
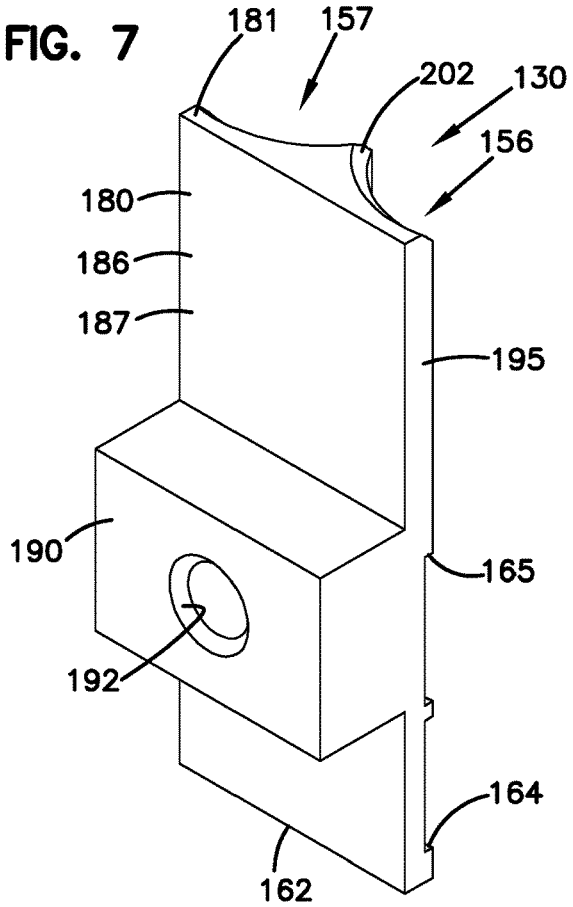
FIG. 7 is another perspective view of the shoulder forming section of FIG. 6.
Figure 8:
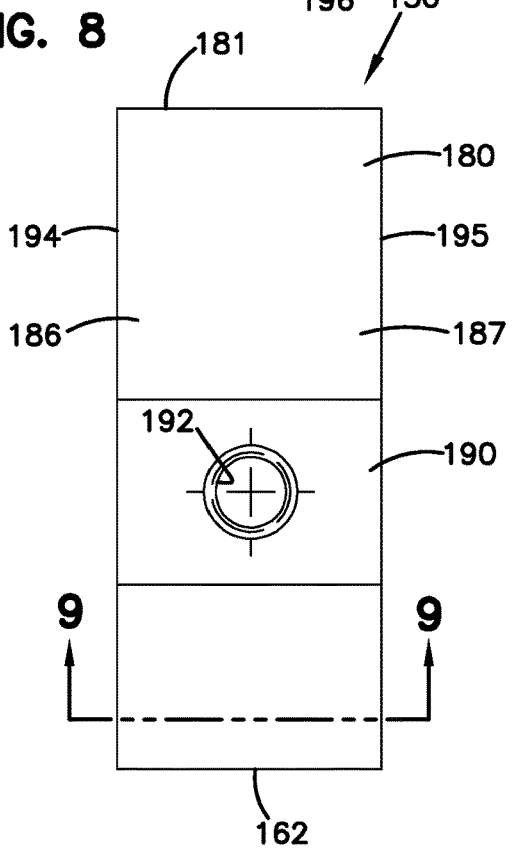
FIG. 8 is a rear view of the shoulder forming section of FIGS. 6 and 7.
Figure 10:
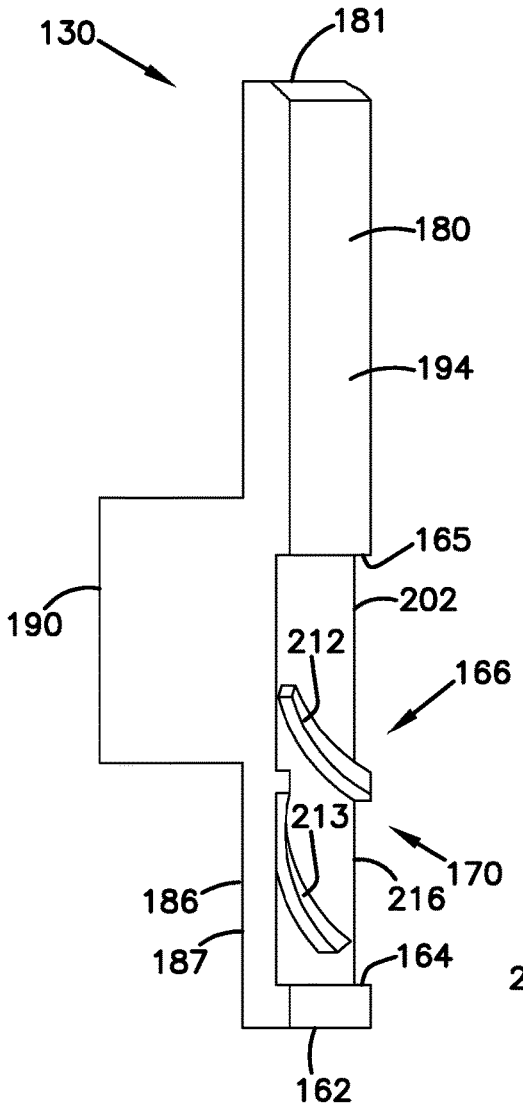
FIG. 10 is a side view of the shoulder forming sections of FIGS. 6-8.

Referring now to FIGS. 6 and 10, the shoulder forming sections 156, 157 each has a recess 158, 159. Each of the recesses 158, 159 is near a bottom edge 162 of the wear plate 130. When installed in the mold box 102, each of the recesses 158, 159 are adjacent the lower edge 160 (FIG. 4) of the mold box 102. In the preferred embodiment depicted, each of the recesses 158, 159 is between 0.25 and 0.35 inch from the bottom edge 162 of the center wear plate 130.

Each recess 158, 159 extends upwardly from the point 164 adjacent the bottom 162 (and when assembled in the mold box 102, adjacent the lower edge 160) to a top point 165 between about 25% and about 50% of the height of the center wear plate 130. When the center wear plate 130 is assembled in the mold box 102, the height of recesses 158, 159 would also be between about 25% and about 50% of the height of the mold box 102. The recesses 158, 159 help to form shoulder roughening arrangements 166, 167, which result in roughened shoulders for a molded block. If the recesses 158, 159 extend much more than 50% of the height of the wear plate 130 and mold box 102, the molded shoulders tend to bulge at the bottom of the block as molded because of too much concrete being pushed through that location. If the recesses 158, 159 are much less than 25% of the height of the wear plate 130 and mold box 102, then the recesses 158, 159 will tend to retain concrete (i.e., they are not self-cleaning), which may result in smooth shoulder sunless the recesses 158, 159 are manually cleaned.

Figure 11:
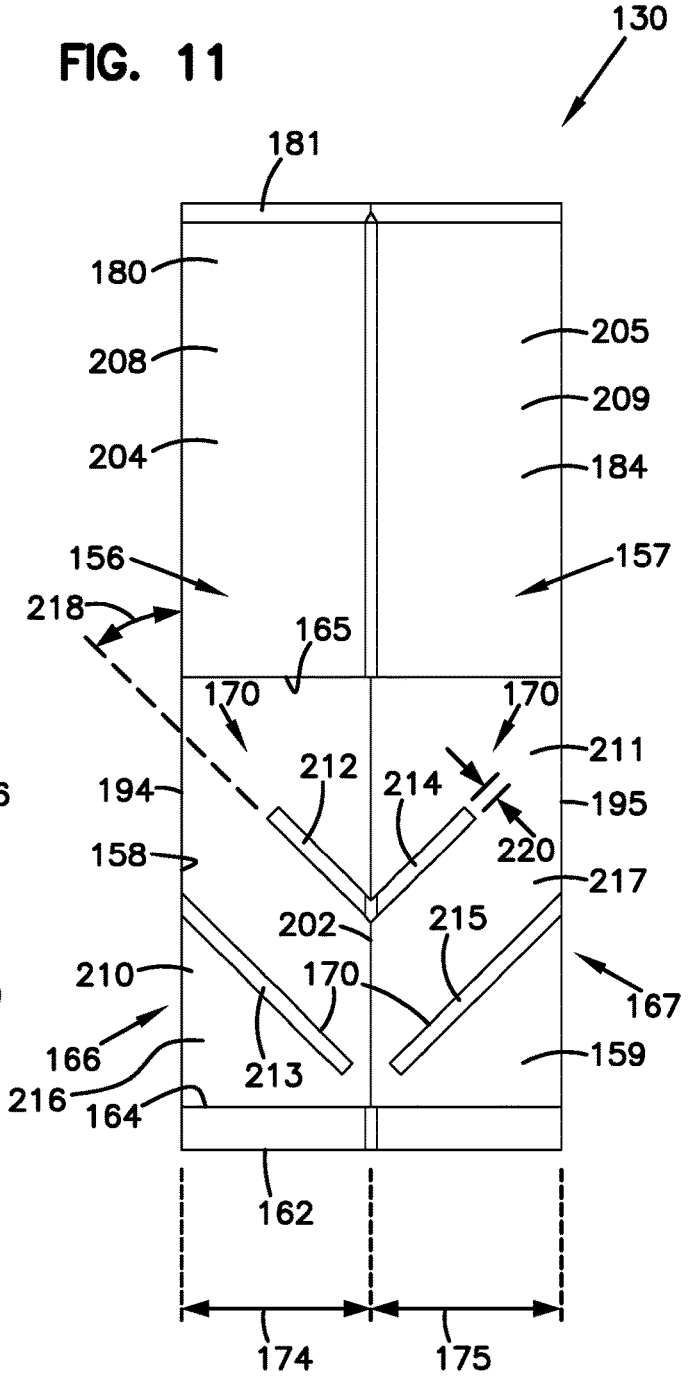
FIG. 11 is a front view of the shoulder forming section of FIGS. 6-10.

In FIGS. 6, 10, and 11, it can be seen how the shoulder roughening arrangements 166, 167 include projections 170 extending from a remaining portion of the shoulder forming sections 156, 157 within each recess 158, 159. When the uncured block is stripped from the mold, the concrete retained in the recesses 158, 159 and the projections 170 roughen the vertical shoulders 78, 79 and 82, 83 of the molded block pair 50.

The projections 170 can include any structure extending or projecting from the recesses 158, 159 such that they. The projections can include, for example, a plurality of spaced segments or dots. In the example shown in FIGS. 6, 10, and 11, the projections 170 are ribs 213-215. The ribs 213-215 are formed in the recesses 158, 159. The ribs 213-215 extend in a direction across the width 174, 175 (FIG. 11) of the recesses 158, 159. Preferably, there are one or more ribs 213-215 formed in each of the recesses 158, 159. The one or more ribs 213-215 together extend across at least a majority of the width 174, 175 of the recesses 158, 159. In preferred embodiments, the one or more ribs 212-215 extend across substantially the entire width 174, 175 of the recesses 158, 159.

In the embodiment depicted in FIGS. 6-11, the center wear plate 130 includes a plate body 180 having a top edge 181 and bottom edge 162. The body 180 includes a molding face 184, which faces the mold cavity 110 and provides a surface against which the concrete mixture engages in order to mold the resulting structure. On a side of the body 180 opposite of the mold face 184 is an outside face 186. The outside face 186 forms an outer surface 187 of the mold box 102 when assembled with the other mold parts.

The outside face 186 includes a projecting lug 190, projecting away from a remaining portion of the outside face 186 and away from the molding face 184. In the example shown, the lug 190 is generally rectangular and is spaced from both the top edge 181 and bottom edge 162. The lug 190 further includes a fastener hole 192 (FIGS. 7 and 8) for accommodating a fastener in order to connect the center wear plate 130 with other portions of the mold, such as side bar assembly 134, 135 (FIG. 5).

Extending between the top edge 181 and the bottom edge 162 and bridging the molding face 184 and outside face 186 are sides 194, 195. The sides 194, 195 have at least two areas of thickness. The first area of thickness 196 (FIG. 6) extends from the top edge 181 to the top point 165 of the recesses 158, 159. The first area of thickness 196 is interrupted by the second area of thickness 200 (FIG. 6), and then resumes again extending from the point 164 at the bottom of the recesses 158, 159 to the bottom edge 162 of the center wear plate 130. The second area of thickness 200 extends between the top point 165 of the recesses 158, 159 and point 164, being the bottom end of the recesses 158, 159. The first area of thickness 196 is greater than the second area of thickness 200. The difference between the first area of thickness 196 and second area of thickness 200 defines the depth of the recesses 158, 159. In one example, this depth is between 0.10 and 0.12 inch, for example about 0.109 inch.

The molding face 184 includes the shoulder forming sections 156, 157 side by side or adjacent to each other. The shoulder forming sections 156, 157 meet at a common, middle edge 202. In the example shown, the middle edge 202 generally bisects the center wear plate 130, being centered between the sides 194, 195. The middle edge 202 extends between the top edge 181 and bottom edge 162. Extending between the middle edge 202 and each respective side 194, 195 is concave shaped molding surfaces 204, 205 (FIG. 11). Each of the concave molding surfaces 204, 205 have a smooth section 208, 209 (FIG. 11) and roughening sections 210, 211 (FIG. 11). The roughening sections 210, 211 are within the recesses 158, 159. The roughening section 210, 211 each has a floor surface 216, 217 (FIGS. 6 and 11).

The roughening section 210 includes the first and second ribs 212, 213 projecting from the floor surface 216. The ribs 212, 213 are generally parallel to each other. The first rib 212 extends from the middle edge 202 at least partly across the roughening section 210, and in the example shown, does not extend to the side 194. The second rib 213 is spaced between the first rib 212 and the bottom 164 of the recess 158. In the example shown in FIG. 11, the second rib 213 extends from the side 194 in a direction toward the middle edge 202, and extends, in the embodiment shown, only partially toward the edge 202. Each of the first and second ribs 212, 213 has a height of about 0.09 inch, which is the distance between the floor surface 216 and the outer surface of the ribs 212, 213. Each of the first and second ribs 212, 213 has a width 220 (FIG. 11) of about 0.104 inch. Other sizes can be used.

The roughening section 211 is analogous to the roughening section 210. The roughening section 211 includes the first and second spaced ribs 214, 215 projecting from floor surface 217. Preferably, the first and second ribs 214, 215 are generally parallel to each other. The first rib 214 extends from the middle edge 202 only partially in a direction toward the side 195. The second rib 215 is spaced between the first rib 214 and the bottom point 164 of the recess 159. The second rib 214 extends from the side 195 only partially in extension to the edge 202. The first and second ribs 214, 215 are generally at the same height and width 220 as the ribs 212, 213, which is preferably about 0.09 inch from the floor surface 217 for height and about 0.104 inch for width In the example depicted in FIGS. 6-11, the first ribs 212, 214 meet along the middle edge 202. From the middle edge 202, the ribs 212, 214 form a V-shape, with the apex being at the edge 202, and each rib 212, 214 extends upwardly as they extend away from the middle edge 202.

The second ribs 213, 215 do not meet along the middle edge 202, in the example shown. The second ribs 213, 215 extend downwardly as they extend from their respective sides 194, 195 toward the bottom edge 162 of the center wear plate 130.

When the center wear plates 130, 131 are operably assembled within the mold box 102, the ribs 212, 213, 214, 215 extend downwardly toward the bottom or lower edge 160 of the mold 100 as it extends from one edge of the recess 158, 159 toward the other edge of the recess 158, 159. From a review of FIG. 4, it can be seen that in the preferred embodiment, the height of each recess 158, 159 is about 50% of the height of the mold box 102.

The angle of the first ribs 212, 214 and second ribs 213, 215 relative to the middle edge 202 and sides 194, 195 at least partially contribute to the wear plates 130, 131 being self-cleaning, by forcing the concrete in the recesses 158, 159 to the middle edge 202 as the block is stripped from the mold box 102. In the example shown in FIG. 11, the ribs 212-215 are at an angle 218 of about 45° relative to respective sides 194, 195. Other angles can be used.

When the center wear plates 130, 131 are assembled in the mold box 102, the concave molding surfaces 204 of the center wear plates 130, 131 are located across the mold from each other in position to form the first and third vertical front shoulders 78, 82 (FIG. 2) of molded block pair 50, which after splitting, results in front shoulders 32, 33 of block 15. Similarly, the concave molding surfaces 205 of the center wear plates 130, 131 are located across the mold 100 from each other to form second and fourth shoulders 79, 83 (FIG. 2) of molded block pair 50, which after splitting, results in front shoulders 32, 33 of block pair 15.

It should be appreciated that in use, the mold 100 can be shaped to result in only a single block 15 in which the center wear plate 130 includes only a single concave mold surface.

D. Methods.

The mold parts described herein can be used in methods for making a dry cast concrete block, such as block 15.

In one example method, the mold 100 is provided. Dry cast concrete is deposited in the mold cavity 110 through the open top 112. The concrete in the mold cavity 110 is compacted by introducing the stripper shoe arrangement 144 through the open top 112. This step includes forming the rounded vertical front shoulders. Next, an uncured concrete block is discharged through the open bottom 114 of the mold box 102 and on to the pallet 104. This step includes roughening the shoulders by the recesses 158, 159 and ribs 212-215 as the uncured block is discharged from the mold.

The uncured concrete block discharged can be a single block having roughened first and second shoulders 32, 33. This single block can then have its front face 22 roughened through a post-molding technique such as using a hammer mill or a by breaking off a chunk of the mold block to form the front face 22. Alternatively, the front face 22 can be formed within the mold itself.

In preferred embodiments, the step of discharging an uncured concrete block includes discharging a uncured concrete block comprising two face-to-face concrete blocks, such as the molded block pair 50. In such a case, there are two adjacent vertical shoulders 78, 79 and 82, 83 midway along each side wall 66, 68. Each of the vertical shoulders 78, 79 and 82, 83 has roughened surfaces by contact between the concrete and the ribs 172 in the recesses 158, 159 of the shoulder forming sections 116, 117 of the mold 100. This molded block pair 50 is then cured, and split along the split line 52 to result in two separate blocks 15. Each block 15 has a pair of vertical shoulders 32, 33 with the front face 22 therebetween. Each of the shoulders 32, 33 and the front face 22 is roughened in appearance. In preferred methods, the molded block pair 50 is split using tooling as described in U.S. Pat. No. 6,874,494, incorporated herein by reference. The tooling in U.S. Pat. No. 6,874,494 has ridges along most of the central portion of the splitter and bullets at the corners of the blocks. The bullets help to break the small shoulder areas that are smooth at the bottom of the blocks as molded, to result in roughened shoulders the entire height of the split block.

The above description includes example principles which may be applied to make many embodiments.

We claim:

1. A wear plate for forming a rounded vertical shoulder of a dry cast concrete block, the wear plate comprising:

(a) a plate body having a top edge and bottom edge, a molding face between the top and bottom edges, an outside face opposite of the molding face, and a side bridging the molding face and outside face;

(i) the molding face defining at least one concave shaped molding surface for forming a rounded shoulder and including a recess;

(ii) the recess extending from adjacent the bottom edge of the plate body and extending upward between about 25% and about 50% of the height of the plate body;

(iii) the concave shaped molding surface having a smooth section and a roughening section, the roughening section being within the recess; and (iv) at least two spaced ribs in the roughening section, each rib extending in a direction across the width of the recess and being inclined relative to the side of the plate body.

2. The wear plate of claim 1 wherein the two spaced ribs are parallel to each other.

3. The wear plate of claim 1 wherein each of the two spaced ribs extends across at least a majority of the width of the recess.

4. The wear plate of claim 1 wherein each of the two spaced ribs is angled about 45° relative to the side of the plate body.

5. The wear plate of claim 1 further including a lug projecting from the outside face, the lug being spaced from the top edge and bottom edge and having a fastener hole to accommodate a fastener to connect the wear plate to other portions of a mold.

6. The wear plate of claim 1 wherein the molding face includes two concave shaped molding surfaces adjacent each other with a middle edge extending therebetween, each concave shaped molding surface having the recess, and each recess including the roughening section with the at least two spaced ribs.

7. The wear plate of claim 6 wherein the middle edge bisects the plate body and extends between the top edge and bottom edge.

* * * * *